US008634274B2

(12) United States Patent
Camwell et al.

(10) Patent No.: US 8,634,274 B2
(45) **Date of Patent: *Jan. 21, 2014**

(54) SPINDLE FOR MUD PULSE TELEMETRY APPLICATIONS

(75) Inventors: Paul L. Camwell, Calgary (CA); David A. Switzer, Calgary (CA); Anthony R. Dopf, Calgary (CA); Laura C. Neels-Slingerland, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/444,693

(22) Filed: Apr. 11, 2012

(65) Prior Publication Data

US 2012/0222899 A1 Sep. 6, 2012

Related U.S. Application Data

(63) Continuation of application No. 12/166,291, filed on Jul. 1, 2008, now Pat. No. 8,174,929.

(60) Provisional application No. 60/929,520, filed on Jul. 2, 2007.

(51) Int. Cl.
*E21B 47/18* (2012.01)

(52) U.S. Cl.
USPC ..... 367/83; 175/40

(58) Field of Classification Search
USPC ..... 367/83–85; 277/354, 367, 369, 405
See application file for complete search history.

(56) References Cited

U.S. PATENT DOCUMENTS

| | | | |
|---|---|---|---|
| 2,759,143 | A | 8/1956 | Arps |
| 2,785,913 | A | 3/1957 | Solari |
| 2,823,058 | A | 2/1958 | Ecker et al. |
| 3,571,936 | A | 3/1971 | Taylor, Jr. |
| 3,739,331 | A | 6/1973 | Godbey et al. |
| 3,741,321 | A | 6/1973 | Slover et al. |
| 3,770,006 | A | 11/1973 | Sexton et al. |
| 3,792,429 | A | 2/1974 | Patton et al. |
| 3,857,156 | A | 12/1974 | Clark |
| 3,949,354 | A | 4/1976 | Claycomb |
| 3,958,217 | A | 5/1976 | Spinnler |
| 4,208,057 | A | 6/1980 | Messenger |
| 4,333,798 | A | 6/1982 | Anthony |
| 4,419,015 | A | 12/1983 | Liddiard |
| 4,535,429 | A | 8/1985 | Russell et al. |
| 4,723,350 | A | 2/1988 | Kobayashi et al. |
| 4,785,300 | A | 11/1988 | Chin et al. |

(Continued)

OTHER PUBLICATIONS

Dietle, et al., Kalsi Seals Handbook, 2005, Section 3, pp. 12-15.

(Continued)

*Primary Examiner* — Daniel P Stephenson
*Assistant Examiner* — Blake Michener
(74) *Attorney, Agent, or Firm* — Klarquist Sparkman, LLP

(57) ABSTRACT

A spindle for a mud pulse telemetry tool includes a seal section having an outer surface for contacting a lip seal of a spindle housing in which the spindle is mounted; a top section attachable to at least part of a valve assembly for generating mud pulses; and a base section having a proximal end attachable to a drive motor for moving the spindle and a distal end attachable to the top section such that the annular seal is fixed between the top and base sections. The seal section can be made of a ceramic material such as yttrium-stabilized zirconia.

20 Claims, 5 Drawing Sheets

(56) References Cited

U.S. PATENT DOCUMENTS

| | | | |
|---|---|---|---|
| 4,802,150 | A | 1/1989 | Russell et al. |
| 4,914,637 | A | 4/1990 | Goodsman |
| 5,040,155 | A | 8/1991 | Feld |
| 5,082,294 | A | 1/1992 | Toth et al. |
| 5,189,645 | A | 2/1993 | Innes |
| 5,213,907 | A | 5/1993 | Caballero |
| 5,636,178 | A | 6/1997 | Ritter |
| 5,787,052 | A | 7/1998 | Gardner et al. |
| 6,053,261 | A | 4/2000 | Walter |
| 6,315,302 | B1 | 11/2001 | Conroy et al. |
| 6,714,138 | B1 | 3/2004 | Turner et al. |
| 6,898,150 | B2 | 5/2005 | Hahn et al. |
| 7,055,828 | B2 | 6/2006 | Hatch et al. |
| 7,057,524 | B2 | 6/2006 | Innes |
| 7,180,826 | B2 | 2/2007 | Kusko et al. |
| 7,330,397 | B2 | 2/2008 | Ganesan et al. |
| 7,468,679 | B2 | 12/2008 | Feluch |
| 2001/0025941 | A1 | 10/2001 | Smith et al. |
| 2006/0034154 | A1 | 2/2006 | Perry et al. |
| 2006/0164917 | A1 | 7/2006 | Ganesan et al. |

OTHER PUBLICATIONS

Office Action from the United States Patent & Trademark Office in U.S. Appl. No. 12/166,291, dated Jul. 7, 2011.

Notice of Allowance from the United States Patent & Trademark Office in U.S. Appl. No. 12/166,291, dated Jan. 10, 2012.

SPINDLE FOR MUD PULSE TELEMETRY APPLICATIONS

CROSS REFERENCE TO RELATED APPLICATIONS

The present application is a continuation of U.S. patent application Ser. No. 12/166,291, filed Jul. 1, 2008 now U.S. Pat. No. 8,174,929 which claims the benefit of U.S. Provisional Patent Application Ser. No. 60/929,520, filed Jul. 2, 2007, both of which are incorporated herein by reference.

FIELD

This invention relates generally to a spindle movable relative to a housing, and particularly to an improved spindle for mud pulse telemetry applications typically used in downhole exploration of oil and gas.

BACKGROUND

Modern drilling techniques employ various means of steering a well when exploring for oil and/or gas. One issue is to ensure that the well's directional profile follows plan in a reasonably accurate manner. This requires steering techniques that make use of downhole drilling motors that are able to steer in certain directions in a controllable manner, requiring the directional driller at surface to have information pertinent to the direction the well is currently taking; this is provided by one of several telemetry techniques. One technique is to produce timed pressure pulses in the drilling fluid (mud) that are detectable at surface. The periodicity of these pulses encodes data typically associated with the orientation of a downhole sensor and certain other information related to downhole conditions, thereby enabling the driller to safely steer the well from the surface. In general this and similar methods of encoding data and sending such information to the surface are called 'Measurement While Drilling' (MWD).

There are several methods by which one can produce the pressure pulses—one common approach is to rotate a rotary vane relative to a stationary vane to vary the degree of obstruction to downhole mud flow.

The downhole fluid pressures can be 20,000 psi or greater. A spindle turns the aforementioned rotary vane and is usually driven by an electric motor, powered by a battery and controlled by electronic circuits. It is necessary to protect the motor and associated devices from the mud; this is conventionally accomplished by incorporating seals between the spindle and the spindle housing. Because the pressure difference between external and internal pressure can be as great as 20,000 psi, a significantly robust seal is needed. This can lead to seal and/or spindle wear problems because of the friction such a seal engenders. Furthermore, the power necessary to rotate the spindle would be dominated by the frictional force between seal and spindle, and as the usual power source to run the motor is a primary cell lithium battery this can become very expensive and/or lead to a greatly reduced downhole operation time. In order to minimize these effects it is advantageous to run the driven section of the spindle behind the seal and the electric motor in oil while balancing the oil pressure with the mud pressure, leaving only a small net pressure differential across the seal. The housing containing the motor assembly can be pressurized to approximately the same as the external pressure by a simple compensation device, such a rubber sleeve internal to the housing, forming a flexible barrier between mud and oil. This enables a relatively small seal to be used, typically incorporating elastomeric seal lips or materials such as PTFE that reduce the coefficient of friction. Despite this property most seals have to cope with wear aggravated by abrasive particulate matter contained in the drilling fluid. Although means can be used to reduce this (for example see Hatch et al., U.S. Pat. No. 7,055,828 whereby the seal incorporates labyrinthine lips in order to help exclude debris) wear can enlarge the opening, allowing drilling fluid ingress and hence lead to ultimate failure or increased friction due to loss of appropriate lubrication, this effect potentially inducing skew distortion that further enables more contamination (see for example Conroy et al., U.S. Pat. No. 6,315,302 in an attempt to reduce the problem by the use of a specifically shaped and energized seal).

Despite these advances, seal wear is inevitable, particularly when the seal has to exclude particulate-containing drilling fluid, so the best that can be done at present is to ensure that the spindle surface minimizes entraining fine particulate abrasive matter that, in effect, will act like rubbing sandpaper along the soft seal lips. Thus it is desirable to make the spindle surface as smooth as is possible, consistent with other material strength properties necessary to support a pressure pulse-producing downhole valve mechanism, and also itself have very low wear properties. The present industry practice is to apply a thermal spray coating of a hard coating, (typically tungsten carbide) to improve the wear properties of the bare metal (typically a stainless steel such as 17-4). An exemplary such spindle is shown in FIG. 1 (Prior Art) wherein a thin tungsten carbide coating 31 of 0.005" to 0.010" has been applied to the base spindle material. Adequate adhesion of tungsten carbide to the metal spindle requires the addition of a binding material such as cobalt or nickel, thereby forming a metallic matrix that requires subsequent grinding to an appropriate smoothness, typically 2 to 8 μ-inches. Of the two binding materials, nickel is generally preferred for its increased resistance to corrosion in the presence of drilling fluids. Regardless of the choice of binder material, the performance of the coating is limited to the porosity, adhesion and corrosion resistance of the available compounds that are suitable for application by thermal spray. Other undesirable issues with hard coatings include a reduction of mechanical properties of the base metal (usually because the necessary heating required to bond the applied coating to the base and sometimes the undesirable formation of intermetallic compounds), limited coating depth that is susceptible to degradation or delamination, no in-situ or in-house repair ability with the accompanying high cost of outsourcing the coating removal and re-application, and inferior performance of the coating relative to a similar solid part made from powder metallurgy.

Maintenance of the surface quality is a major issue in the long term performance of the sealing surface. Degradation of the seal surface occurs frequently and plays a large role in limiting the lifetime of the spindle and seal. Also, refinishing or replacement of the sealing surface is routinely required—a discussion of such concerns can be found in the Kalsi Seals Handbook, 2005, Section 3, pp 12-15.

The underlying spindle material is usually chosen to be a tough, corrosion-resistant metal. In a MWD drilling environment, excellent mechanical properties are required for this metal to resist the axial, rotational and radial forces on the rotary vane due to drill string shock (thousands of Gs) and vibration (tens of Gs), as well as high frequency vibration and large pressure loading due to the generation of ~300 psi pressure pulses in turbulent flow. In addition, the most highly stressed area of the spindle is exposed to the drilling fluid and must survive chemical attack and erosional flow created when pressure pulses are produced.

An alternative method of producing a pressure pulse is to linearly move a poppet into and out of an orifice (poppet & orifice valve), thereby changing the drilling fluid flow rate through the valve and using this to subsequently create pressure pulses. At issue here is the need to drive the shaft, the distal end of which is typically within the drilling fluid. This necessitates a seal because the shaft driver is usually an electric motor or a solenoid, both of which normally require protection within a lubricant-filled housing. Such seals are either similar to rotary seals or are of a bellows type, and the technique similarly needs pressure compensation. The method is typified by U.S. Pat. No. 6,898,150 (Hahn et al., 2005) that utilizes a stationary valve and reciprocating poppet driven by an electric motor in a lubricant-filled housing. The problems inherent in this approach are either that the seal has enhanced wear compared to a rotary seal due to the ingress of contaminants between the shaft and the elastomeric seal lips, particularly as the spindle is pulled back through the seal, or there is restricted stroke because the seal is a bellows type.

The properties of the spindle thus far described should preferably incorporate a smooth sealing surface in the location of the elastomeric seal, be resistant to erosion and chemical attack, and also be mechanically strong enough to withstand severe downhole axial and radial forces while supporting and operating the valve, and be slender enough to minimize the net frictional (circumferential) forces as the spindle moves within the seal. Other desirable properties are to make this spindle inexpensive to manufacture and easy to maintain. The present art does not optimally address the best economically-possible smoothness requirement although a step toward better maintenance was taken by Messenger (U.S. Pat. No. 4,208,057) in his teaching of a 2-part spindle, whereby the distal end of this design could be removed without undue disturbance of the proximate end for maintenance purposes. But Messenger still falls short in providing both cost effective manufacture and a superior smooth sealing surface. Further, no other art to date addresses these issues plus methods of alleviating other concerns noted herein, within one comprehensive design.

SUMMARY

In particular embodiments, one object of the technology of the present disclosure is to provide an improved spindle for mud pulse telemetry applications that provides a solution to at least one of the deficiencies of the prior art.

According to a first aspect, there is provided a spindle for a mud pulse telemetry tool. The spindle includes a seal section having an outer surface for contacting a lip seal of a spindle housing in which the spindle is mounted; a top section attachable to at least part of a valve assembly for generating mud pulses; and a base section having a proximal end attachable to a drive motor for moving the spindle and a distal end attachable to a proximal end of the top section such that the seal section is fixed between the top and base sections. The spindle may be compressively fixed between the top and base sections.

The valve assembly may include rotary vanes attachable to the top section and stationary vanes attached to the spindle housing, and the drive motor is operable to rotate the spindle. Alternatively, the valve assembly may include a poppet attachable to the top section and an orifice between the tool and a tool housing in which the tool is mounted, and the drive motor is operable to move the spindle in an axially reciprocating manner.

The distal end of the base section and the proximal end of the top section can be matably threaded and be configured to be screwed together. Additionally, the seal section may have an inner surface defining an annular bore. The annular bore may be threaded such that the top section can be screwed therethrough. The spindle may further include a seal disposed between the seal section and the base section, and the seal may be an o-ring. An overshot may be disposed on a distal end of the top section.

The spindle can further include bearing assemblies disposed between the spindle and the spindle housing for axially and radially constraining the spindle, the bearing assemblies located at or near the distal end of the base section such that cantilevered bending forces applied to the spindle are reduced.

Alternatively, the seal section of the spindle can have a ceramic outer surface, which can be yttrium-stabilized zirconia. The top section may include nickel cobalt alloy, and the outer surface can be polished to a roughness of less than 1 μ-inch.

The foregoing and other objects, features, and advantages of the invention will become more apparent from the following detailed description, which proceeds with reference to the accompanying figures.

DETAILED DESCRIPTION

According to one embodiment of the invention and referring to FIGS. 2 to 5, a mud pulse telemetry tool includes a three-piece rotary spindle that is particularly cost-effective to manufacture and maintain while providing all of the features necessary to serve its purpose in the tool. According to a second embodiment of the invention, the mud pulse telemetry tool includes a three piece axially movable spindle that also enjoys the same advantages and benefits as the rotary spindle. These embodiments are particularly beneficial for mud pulse telemetry transmitters commonly used in the downhole exploration of oil and gas, but will also have use in other seal usage applications.

Figure 1:
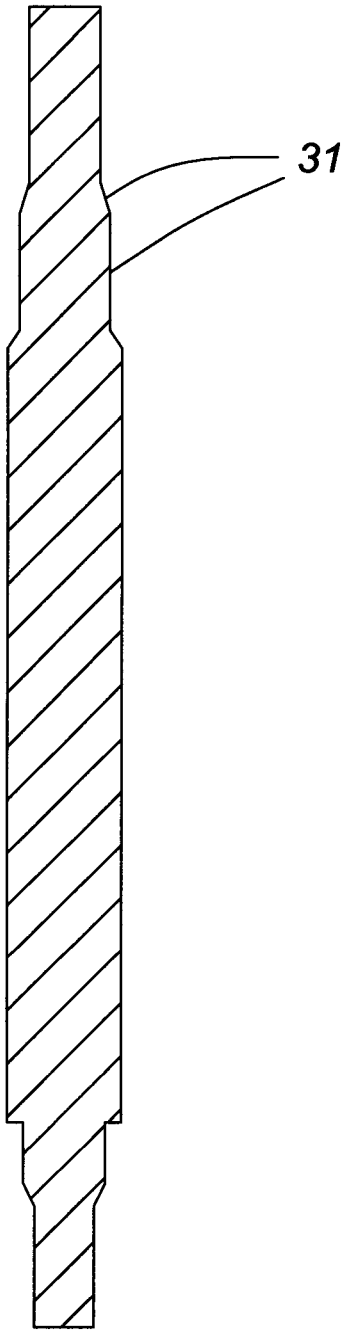
(PRIOR ART) FIG. 1
FIG. 1 (PRIOR ART) is a schematic side view of a prior art version of a one piece rotary spindle for use in rotary mud pulse telemetry applications.
Figure 2:
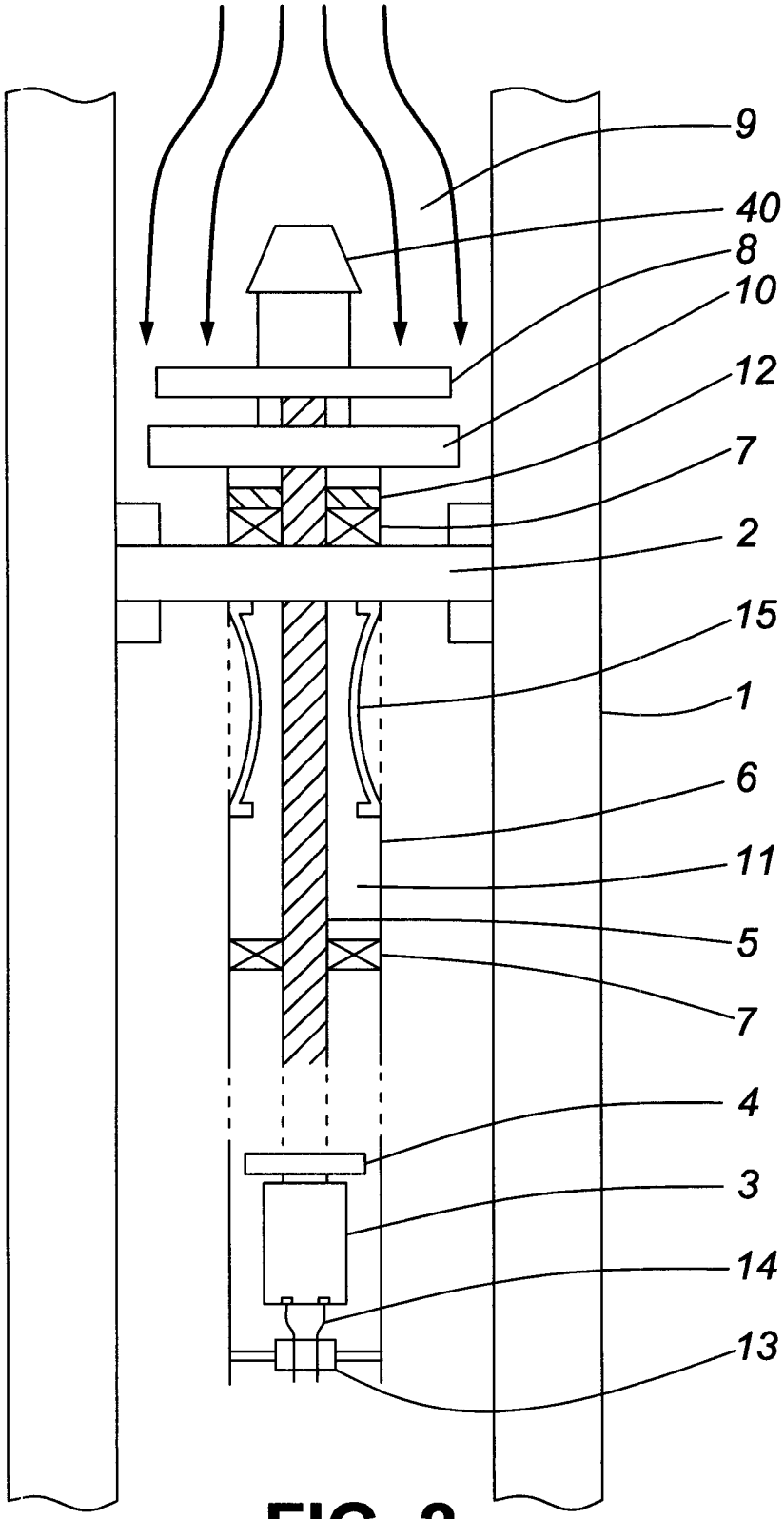
FIG. 2 is a schematic cross-sectioned view of a rotary mud pulse telemetry tool installed in a drill collar according to one embodiment of the invention.

Referring now to FIG. 2, a rotary mud pulse telemetry tool is installed in a custom matched drill collar 1 by means of a fixed support 2. An electric motor 3, whose output position is controlled by sensing elements 4, is coupled to the proximal end of a spindle 5. Together they provide the drive assembly that causes and controls the rotation of the spindle 5. The spindle 5 is axially and radially constrained but rotatable within a fixed housing 6 by means of a system of distal and proximal roller bearing assemblies 7. A set of rotatable rotary vanes 8 is attached near the distal end of the spindle 5. The rotary vanes 8 have spaces between each vane and rotates with the spindle 5. The rotary vanes 8 are mounted axially over stationary vanes 10 which are fixed to the housing 6 and also have spaces in between the vanes. Rotation of the rotary vanes 8 relative to the stationary vanes 10 alternately increases and decreases the available flow area for the drilling fluid (mud) 9 through the tool. The flow of mud through the vanes 8, 10 produce a timed pattern of pressure pulses decodable at surface, wherein the timing is controlled by the rotation of the rotary vanes 8 relative to the stationary vanes 10.

A non-conductive hydraulic fluid such as oil 11 is contained in the portion of the housing 6 between a rotary lip seal 12 at the housing's distal end and a fixed pressure feed-through seal 13 at the housing's proximal end. The fixed pressure feed-through seal 13 provides a feed-through for electrical wiring 14 to the motor 3 from control electronics (not shown). The pressure changes across the seals are kept to a minimum by pressure balancing the hydraulic oil by means of a flexible membrane 15.

The control electronics encode transmission data into mud pulses and instructs the motor 3 to rotate the rotary vanes 8 via the spindle 5 in a manner to generate such pulses. The data, for example, can be downhole measurement data recorded by sensing elements that would normally be built into housing 6 and positioned below the pressure feed-through seal 13.

Drilling fluid 9 that has passed though the vanes 8, 10 then travels past the outside of the housing 6 and continues along through the drill collar 1.

Figure 3:
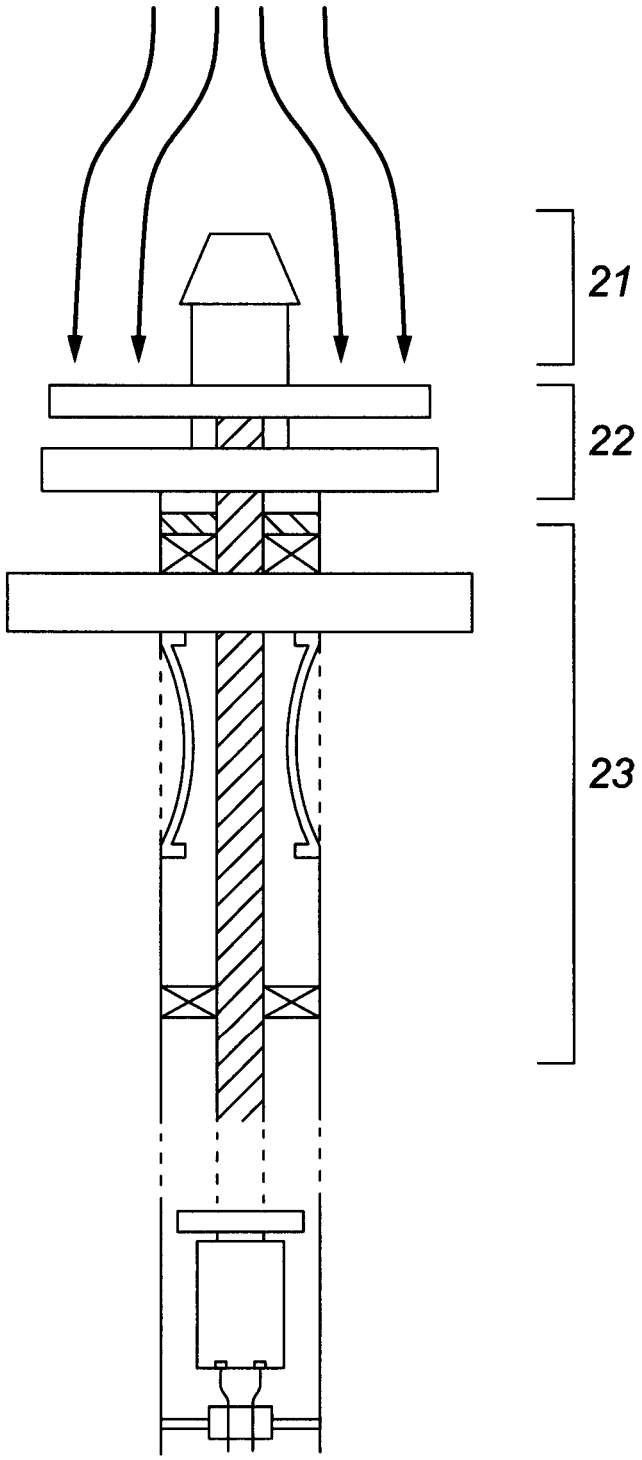
FIG. 3 is a schematic cross-sectioned view of the rotary mud pulse telemetry tool.

Referring now to FIG. 3, the spindle 5 has a distal (top) section 21 that protrudes out of the housing 6 into the mud flow and thus should be able to withstand high mechanical loading due together with chemical and erosive attack due to its exposure to the drilling fluid 9. A central section 22 of the spindle 5 contacts the lip of seal 12 and together with the body of the seal 12 serves to isolate the housing 6 from the drilling fluid 9 yet allow rotation of the spindle 5 relative to the housing 6. A proximal (bottom) section 23 of the spindle 5 must provide rigidly-constrained, rotary motion and withstand the torque required to drive the rotary vanes 8.

Figure 4:
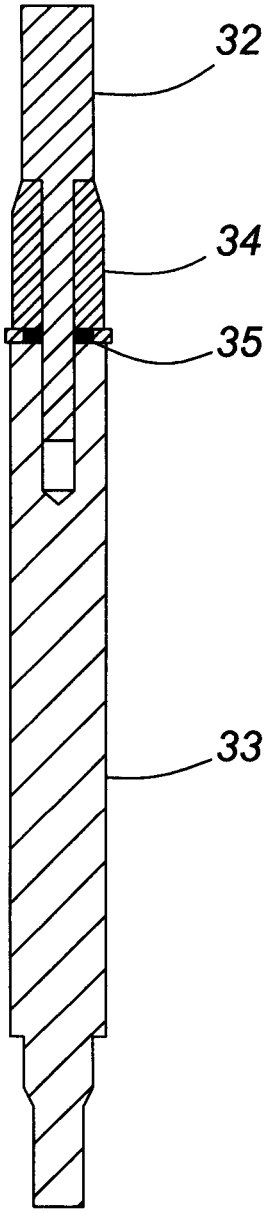
FIG. 4 is a schematic side view of a three-piece rotary spindle used in the rotary pulse telemetry tool shown in FIGS. 2 and 3.
Figure 5:
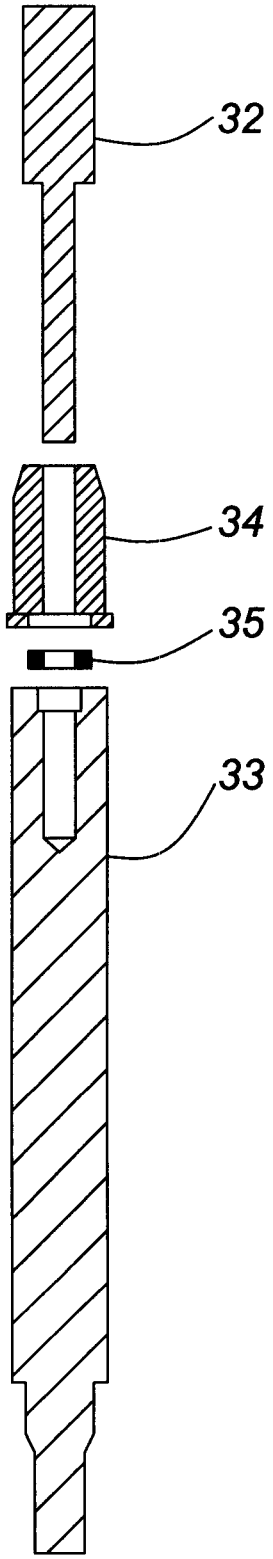
FIG. 5 is an exploded schematic side view of the three-piece rotary spindle shown in FIG. 4.

Referring now to FIGS. 4 and 5, the spindle 5 comprises three segments: a top section 32, a base (lower) section 33 and a seal section 34.

The top section 32 has a distal portion to which the rotary vanes 8 fixedly attach and a threaded proximal portion which engages with mating threads in the base section 33. The rotary vanes 8 can be attached to the distal portion by a number of different means known in the art, e.g. by mating threads on a portion of the exterior surface of the distal portion and on the inside circumference of the rotary vanes 8.

The base section 33 has a threaded cavity at its distal end which receives the threaded proximal portion of the top section 32. The proximal end of the base section 33 is tapered and configured to fixedly attach to the drive motor 3. The seal section 34 is an annular body that has an axial bore through which the proximal end of the top section 32 can be threaded. The spindle 5 is assembled by threading the top section 32 through the seal section 34 bore then screwing same into the distal end of the base section 33 until the seal section 34 is clamped under compression between the top and base sections 32, 33. An o-ring 35 is provided in an annular shoulder at the proximal end of the seal section 34 bore to prevent an internal path within the spindle 5 for fluid transfer.

The design of the three-piece spindle 5 separates each functional area of the spindle into a separate part 32, 33, 34 that can be optimized for its particular design constraints, each largely independent of the others. In one embodiment, the top and lower spindle sections are joined by threading and subsequent clamping the central seal section 34 in place between them, although other similar connection methods could be implemented, as would be obvious to one skilled in the art.

When assembled, the spindle 5 is mounted in the housing 6 such that the spindle 5 is rotatable within the housing 6 but constrained axially and laterally. The spindle 5 is positioned in the housing 6 such that the distal roller bearing assembly 7 surrounds and contacts the distal end of the base section 33, and seal 12 surrounds and contacts the outer cylindrical surface of the seal section 34. Consequently, the distal portion of the top section 32 protrudes distally out of the housing 6 such that the rotary vane 8 attached to the top section 32 is axially juxtaposed over the stationary vane 10, which is fixed to the distal end of the housing 6. An overshot 40 is capped over the top section 32 and provides a more streamlined flow of mud past the vanes 8, 10. The proximal roller bearing assembly 7 surrounds and contacts the base section 33 thereby allowing rotation but laterally fixing the spindle 5 by standard mechanical shouldering means (not shown).

The distal roller bearing assembly 7 is placed as near the distal end of the base section 33 as possible so that the effect of cantilevered bending forces applied to the spindle 5 through the operating action of the vane section 22 are minimized. The importance of this is due to the need for the axial gap between stationary vane 10 and rotary vane 8 to be held to tight tolerances in order to create accurate amplitude pressure pulses for a given drilling fluid flow rate range.

In this embodiment, the seal section 34 is manufactured from a ceramic that can be made smooth and be resistant to exposure to the mud, namely to be resistant to chemical attack, erosion from high velocity fluid flow and mechanical degradation due to abrasive particles in the mud. A particularly suitable such material is yttrium-stabilized zirconia. This material is a very mechanically tough ceramic that is highly resistant to chemical and erosion attack. This material can be highly polished, yielding a surface roughness of less than 1 μ-inch. In testing, we have found that after drilling a well lasting 2 to 4 days, the surface finish for a tungsten carbide spindle (prior art) was usually in the range of 8 to 32 μ-inches, while the surface finish of the zirconia spindle 5 for similar wells was typically 4 to 8 μ-inches. While the zirconia seal section 34 does wear eventually, only a minor polish using a fine diamond lap applied to reduce surface discoloration, even after hundreds of days operation, is required.

When the seal section 34 is made entirely from a solid material comprising a sleeve, it will typically have superior properties (such as greater strength, resistance to brittle cracking etc.) in comparison to a seal section 34 having thermally sprayed compounds. It will typically also offer better chemical resistance, lower porosity, no tendency to delaminate, and more consistent properties as it wears.

In use, the spindle top section 32 will be exposed, at least to some degree, to the drilling fluid. This exposure may cause possible material loss due to flow erosion or possibly chemical attack. Since the roller bearing assemblies 7 run in oil 11 and lie behind the seal 12, the exposed spindle area will be cantilevered past the region of bearing support, increasing the stress under loading. Also, the highly turbulent flow around the rotary vanes 8 will cause rapidly changing pressure differentials around the rotary vanes 8 and impart large mechanical loads to the top of the spindle 5. In almost all conventional single or two-piece designs, the choice of material for the entirety of the spindle will often be driven primarily by the strength requirements of the top section, thus increasing the spindle cost. Moreover, when damage to the exposed area occurs (for instance when debris swept at high velocity by the drilling mud impacts the rotary vanes 8), replacement of the entire spindle is often necessary. In contrast, the spindle 5 according to the present embodiment of the invention has a top section 32 manufactured from a high strength material such as high strength nickel cobalt alloy. The use of a separate top section 32, removable from the remaining spindle sections 33, 34, separates the design constraints for the exposed cantilevered section from the remaining spindle length. This allows the cost-effective use of exotic metal alloys with exceptionally high tensile strength properties (when compared to stainless steel) as such materials are used only where required. Furthermore, the separable nature of the spindle components 32, 33, 34 allow individual components 32, 33, 34 to be replaced when necessary instead of the whole spindle 5.

In addition, the top section 32 can have a reduced diameter in comparison with a weaker material and so commensurately reduces the diameter of the seal section 34 which in turn reduces the force necessary to turn the spindle 5 against the grip of the seal 12, thereby leading to battery power savings.

The spindle base section 33 is lubricated and will typically be constrained by roller bearing assemblies 7 at multiple points and will not face wear, corrosion, or hardness concerns. Its chief purpose is to position and hold the rotary vanes 8 such that they rotate relative to the stationary vanes 10, and to transmit the required torque for said rotation. For these functions the mechanical properties required can be met by a range of less expensive materials. Therefore removing the requirements for sealing and high strength from the base section 33 allows for the use of many low price alloys without sacrifice in the overall performance of the spindle 5.

An additional advantage of the three-piece design is that the centre ceramic wear sleeve seal section 34 can be axially clamped between the top and bottom sections 32 and 33 respectively. The clamping force imparts a compressive stress to the ceramic and since ceramics are very strong under compression the clamping force acts to toughen the ceramic and increase its resistance to brittle fracture, which normally occurs in tension. In contrast, an unclamped ceramic sleeve would be significantly more prone to cracking under loading due to bending and impact. Furthermore it reinforces the resistance of the top section 32 to lateral forces, reducing the need to otherwise have a larger diameter along the slimmer section of the spindle top section.

Figure 6:
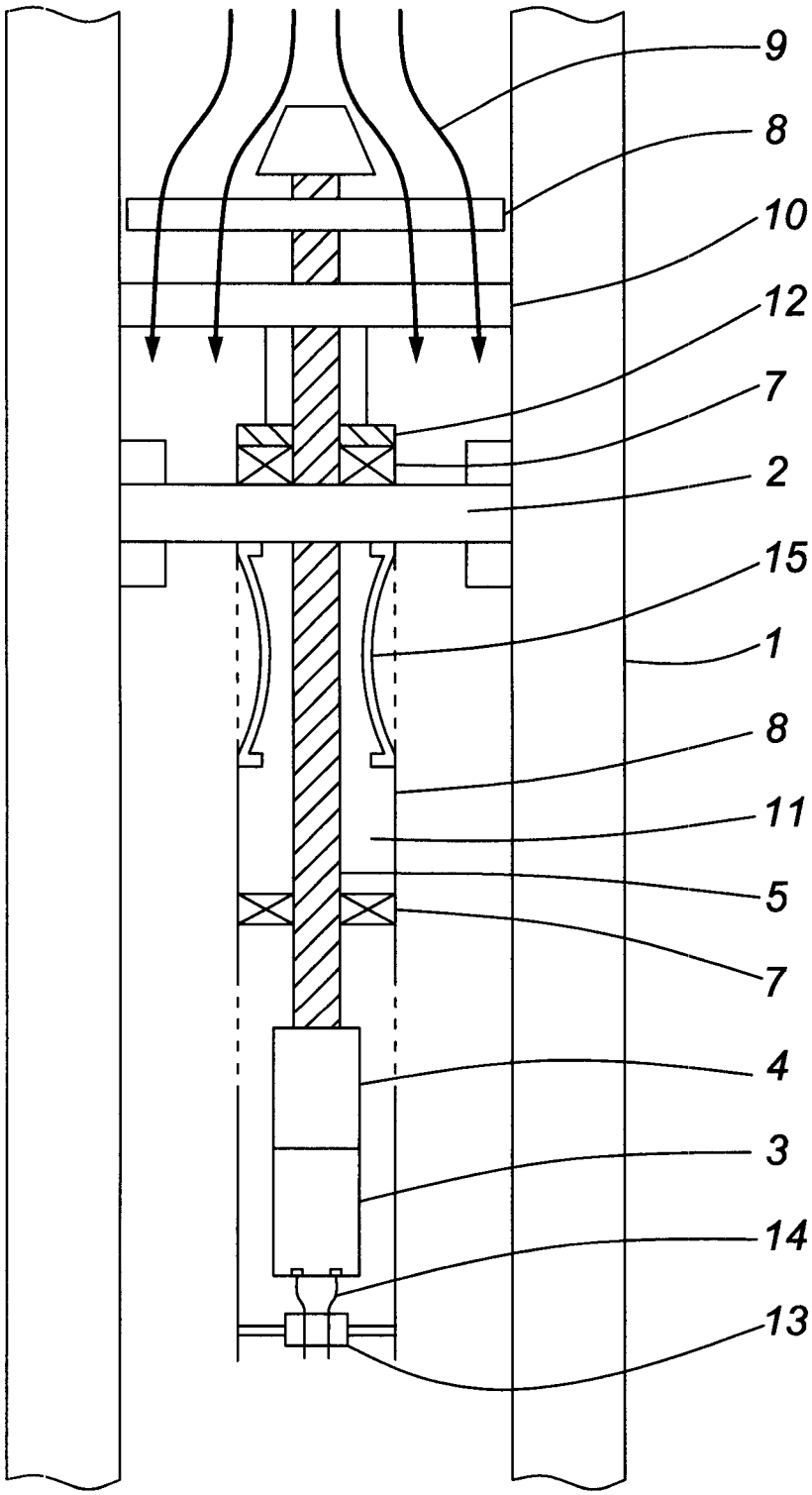
FIG. 6 is a schematic cross-sectioned view of a mud pulse telemetry tool installed in a drill collar according to another embodiment of the invention wherein the tool axially reciprocates in order to generate mud pulses.

Referring now to FIG. 6, there is illustrated a second embodiment of the invention, a mud pulse telemetry tool depiction which is essentially the same as the one described in the first embodiment, except that rotary motion of the spindle 5 and vanes 8 are replaced by axially reciprocating components. Instead of the rotary and stationary vanes 8, 10, a different valve assembly is provided. For convenience we retain the numbering of assemblies 8 and 10 because the previously mentioned vanes are retained but in this embodiment serve a different purpose. As previously understood the vanes rotate into open or closed positions; now we orient them to the closed position but displace them axially. It is evident that fluid flow is opposed to a lesser extent when there is a relatively large axial distance between assemblies 8 and 9 than when they are closer together. This is simply a variation of a standard poppet/orifice valve that utilizes the proximity of a poppet to an orifice to constrict or enable fluid flow. In our explanatory embodiment we simply move the erstwhile rotary vane 8 (analogous to a poppet) closer to or further from the stationary vane 10 (analogous to an orifice). This is accomplished by the drive motor 3 being modified to move the spindle 5 in an axially reciprocating motion instead of rotary motion by incorporating a rotary-to-linear mechanism 4. Bearings 7 are chosen to accommodate axial movement, and the seal 12 can still be a lip seal or alternatively a bellows type seal (not shown).

In both embodiments, separating the spindle 5 into three main functional parts results in an improved assembly where each part can be tailored to its specific constraints. The following is a summary of the benefits of each component and of an assembled spindle comprising these components:

Top Section 32
- exceptionally high tensile strength provides good resistance to lateral bending forces,
- reduced diameter reduces force needed to rotate the spindle 5 against the friction of the lip seal 12,
- increased wear resistance against erosion and chemical attack, and
- easy to replace thereby reducing overall spindle manufacturing costs.

Seal Section 34
- very smooth wear surface for better performance with lip seal,
- can be relatively small thereby reducing material cost, and
- easy to replace thereby reducing overall spindle manufacturing costs.

Lower Spindle Section 33
- can be made of a relatively inexpensive steel thereby reducing manufacturing costs.

Assembled Spindle 5:
- brittle fracture of the seal section 34 can be minimized when the component is under compression,
- the threaded part of the upper section 32 is stiffened by the presence of the seal section 34, leading to greater resistance to bending loads associated with forces affecting the vanes 8, 10.

This spindle design enhances the robustness of each of the three sections 32, 33, 34 as they are now able to be individually better optimized in the design characteristics as discussed. Cost savings accrue as repairs are most likely to pertain to exposed parts of the spindle, not all. Therefore, the separation of the spindle 5 into the three functional components 32, 33, 34 will greatly reduce the frequency and cost of repair and maintenance, and enhance operational longevity.

While a particular embodiment of the present invention has been described in the foregoing, it is to be understood that other embodiments are possible within the scope of the invention and are intended to be included herein. It will be clear to any person skilled in the art, that modifications of and adjustments to this invention, not shown, are possible without departing from the spirit of the invention as demonstrated through the exemplary embodiment. The invention is therefore to be considered limited solely by the scope of the appended claims.

We claim:

1. A spindle for a mud pulse telemetry tool comprising:

(a) a seal section having an outer surface for contacting a lip seal of a spindle housing in which the spindle is mounted;

(b) a top section attachable to at least part of a valve assembly for generating mud pulses; and (c) a base section having a proximal end attachable to a drive motor for moving the spindle and a distal end directly connected to a proximal end of the top section whenever the spindle is assembled such that the seal section is compressively fixed between the top and base sections.

2. A spindle as claimed in claim 1 wherein the seal section has an inner surface defining an annular bore.

3. A spindle as claimed in claim 2 wherein the annular bore is threaded such that the top section can be screwed therethrough.

4. A spindle as claimed in claim 3 further comprising a seal disposed between the seal section and the base section.

5. A spindle as claimed in claim 4 wherein the seal is an o-ring.

6. A spindle as claimed in claim 5 further comprising an overshot disposed on a distal end of the top section.

7. A spindle as claimed in claim 1 wherein the outer surface is ceramic.

8. A spindle as claimed in claim 7 wherein the outer surface comprises yttrium-stabilized zirconia.

9. A spindle as claimed in claim 8 wherein the top section comprises nickel cobalt alloy.

10. A spindle as claimed in claim 9 wherein the outer surface is polished to a roughness of less than 1 μ-inch.

11. A spindle for a mud pulse telemetry tool comprising:

(a) a seal section having a ceramic outer surface for contacting a lip seal of a spindle housing in which the spindle is mounted;

(b) a top section attachable to at least part of a valve assembly for generating mud pulses; and (c) a base section having a proximal end attachable to a drive motor for moving the spindle and a distal end directly connected to a proximal end of the top section such that the seal section is compressively fixed between the top and base sections.

12. A spindle as claimed in claim 11 wherein the distal end of the base section and the proximal end of the top section are matably threaded and are configured to be screwed together.

13. A spindle as claimed in claim 12 wherein the seal section has an inner surface defining an annular bore.

14. A spindle as claimed in claim 13 wherein the annular bore is threaded such that the top section can be screwed therethrough.

15. A spindle as claimed in claim 14 further comprising a seal disposed between the seal section and the base section.

16. A spindle as claimed in claim 15 wherein the seal is an o-ring.

17. A spindle as claimed in claim 16 further comprising an overshot disposed on a distal end of the top section.

18. A spindle as claimed in claim 11 wherein the ceramic outer surface comprises yttrium-stabilized zirconia.

19. A spindle as claimed in claim 18 wherein the top section comprises nickel cobalt alloy.

20. A spindle as claimed in claim 19 wherein the ceramic outer surface is polished to a roughness of less than 1 μ-inch.

* * * * *